United States Patent [19]

Schrage et al.

[11] 4,000,968

[45] Jan. 4, 1977

[54] PERMANENT PRESS CYCLE FOR AUTOMATIC WASHER

[75] Inventors: Joy A. Schrage, Berrien Center; John William Pielemeier, St. Joseph; James I. Czech, Stevensville, all of Mich.

[73] Assignee: Whirlpool Corporation, Benton Harbor, Mich.

[22] Filed: Nov. 13, 1975

[21] Appl. No.: 631,440

Related U.S. Application Data

[62] Division of Ser. No. 503,665, Sept. 6, 1974, abandoned.

[52] U.S. Cl. ..... 8/158; 8/159; 68/23.5; 68/207

[51] Int. Cl.[2] ..... D06F 13/02; D06F 23/04; D06F 39/08

[58] Field of Search ..... 8/158, 159; 68/12 R, 68/23.5, 23.7, 207

[56] References Cited

UNITED STATES PATENTS

| | | | |
|---|---|---|---|
| 3,304,751 | 2/1967 | Schwing | 68/23.5 |
| 3,477,258 | 11/1969 | Walker et al. | 68/23.5 X |
| 3,550,171 | 12/1970 | Anthony et al. | 68/12 R X |
| 3,604,220 | 9/1971 | Taylor | 68/12 R |

*Primary Examiner*—Philip R. Coe
*Attorney, Agent, or Firm*—Hill, Gross, Simpson, Van Santen, Steadman, Chiara & Simpson

[57] ABSTRACT

A method for minimizing setting of wrinkles in fabrics, particularly permanent press fabrics, during a liquid extraction cycle by adding moisture to the fabrics while they are being centrifuged to maintain their level of moisture content above a predetermined value.

6 Claims, 4 Drawing Figures

Fig. 1
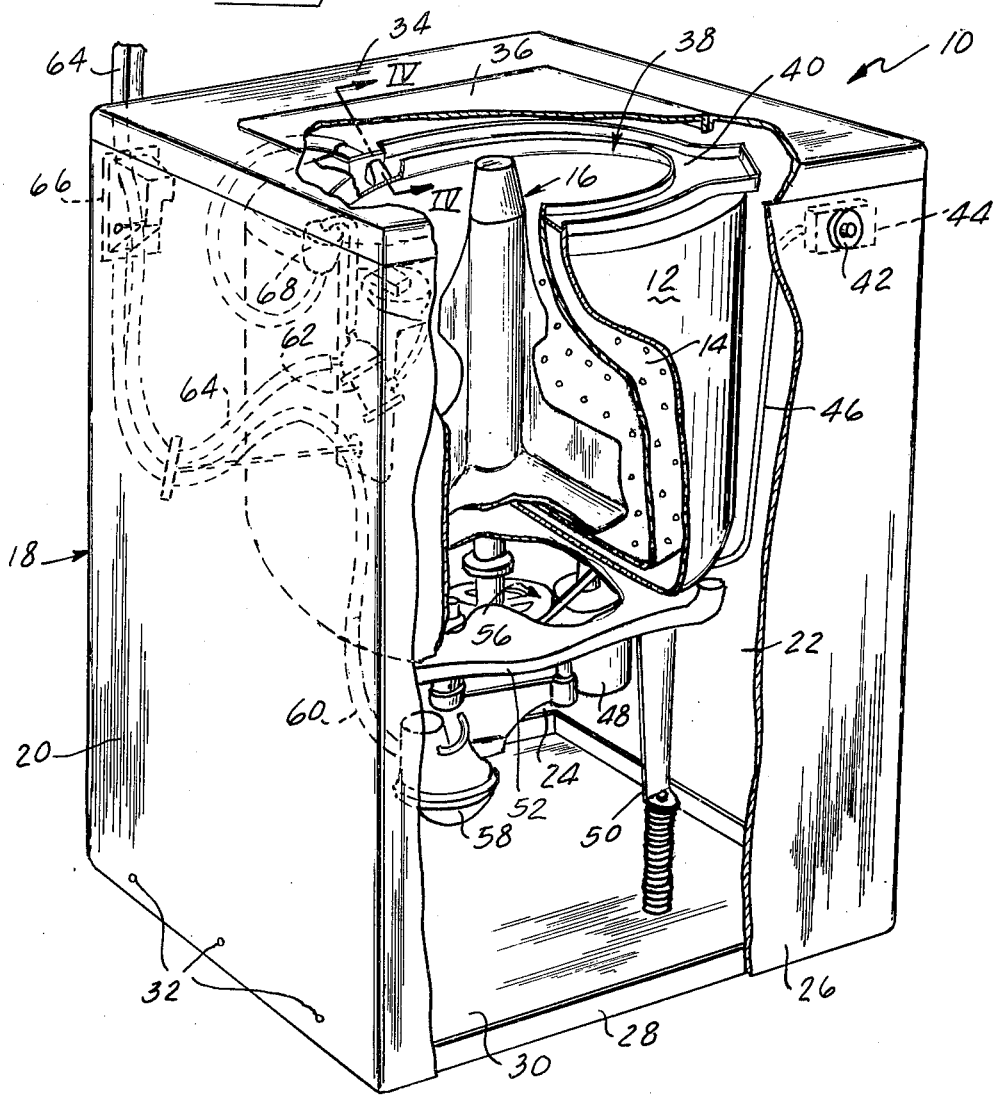
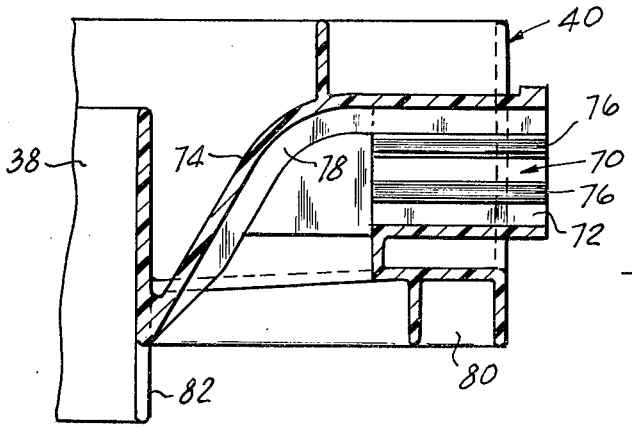
Fig. 4

PERMANENT PRESS CYCLE FOR AUTOMATIC WASHER

This is a division of application Ser. No. 503,665, filed Sept. 6, 1974 and now abandoned.

BACKGROUND OF THE INVENTION

1. Field of the Invention

This invention relates to automatic clothes washing machines, and more particularly to a method and apparatus for minimizing the "setting" in of wrinkles in fabrics during a liquid extraction cycle.

2. Description of the Prior Art

The usual method for extracting moisture from clothes in an automatic washer is to centrifuge the clothes load at a high speed to force out the water. With permanent press fabrics, however, difficulties arise in that the centrifuging process may result in the fabrics becoming pressed causing the introduction of wrinkles. In some cases, the wrinkles become "set" into the fabric and cannot be entirely removed in a subsequent drying process, whether that process involves the use of a dryer or hanging the clothes on a clothes line. A drying machine normally does a better job of removing wrinkles from synthetic fabrics than can be achieved by hanging the fabrics to dry on a clothes line since the heat from the dryer tends to "relax" the fabrics; however, if the wrinkles are sufficiently "set" into the fabric during the centrifuging operation in the washer, they may not be removed, even when the fabrics are dried in a clothes dryer.

As will be noted below, the "setting" of wrinkles in permanent press fabrics may be lessened by reducing the spin speed of the washer, but for normal fabrics a high spin speed is desirable to efficiently centrifuge moisture therefrom.

One technique for overcoming the aforementioned "setting" in of wrinkles problem is to provide a multi-speed motor, usually a two-speed motor, so that a spin speed may be utilized during a permanent press cycle, without sacrificing effectiveness or efficiency in other washer performance areas. The provision of a multi-speed motor is, however, a disadvantage in that such motors are substantially more expensive than single speed motors.

Another possible solution to the problem of setting in wrinkles is to limit the duration of a high speed spin so that excessive moisture removal will not occur. This approach is generally not feasible due to mechanical limitations in the timer mechanism of the machine, and would also be undesirable due to the possibility that regular fabrics could remain excessively wet at the end of the machine cycle where permanent press and normal fabrics were combined in a single load.

Techniques for adding liquid to fabrics being dried in a clothes dryer are well known in the art. For example, D. L. Clark in his U.S. Pat. No. 2,846,776 teaches the introduction of a liquid spray to the interior of a dryer drum through the utilization of compressed air.

P. W. Douglas U.S. Pat. No. 3,570,272 discloses the use of a liquid spray of long duration during a spin cycle of an automatic washer in order to obtain a more efficient suds removal and N. S. McEwen U.S. Pat. No. 2,915,890 discloses the provision of a liquid spray in a clothes washer for rinsing.

A. U. Khan et al, in their U.S. Pat. No. 3,116,243, assigned to Whirlpool Corporation, disclose the provision of a liquid spray from outside a perforate drum as an aid in removing clothes adhering to the wall of the drum.

In U.S. Pat. No. 3,526,105, T. B. Anthony teaches the use of a low speed spin as a means of gently extracting moisture from permanent press fabrics.

SUMMARY OF THE INVENTION

A primary object of the present invention, therefore, is to provide a method for preventing setting of wrinkles, in particular in permanent press fabrics, during the liquid extraction cycle of an automatic washer.

Another object of the invention is to provide a method to prevent the setting of wrinkles during the extraction cycle of an automatic washer which operates with a high speed spin.

According to the invention, the solution to the aforementioned problem lies in the provision of a liquid spray for adding liquid to the fabrics during the spin mode of a permanent press cycle. This spray maintains the moisture content of the fabrics at or above a predetermined level so that at the termination of the cycle there will be no wrinkles set in the fabrics.

According to an advantageous embodiment of the invention, the spray is added through the machine's inlet nozzle mounted on the tub ring and controlled by the water inlet valve in conjunction with the programmer of the washing machine. The programmer, in order to provide this feature, includes a set of contacts which are intermittently operated during at least a portion of a spin cycle to introduce water into the tub of the machine. The water introduced through the inlet nozzle strikes the agitator which is spinning with the tub, and the water is atomized and deflected onto the fabrics collected around the inside surface of the basket. The spray may be added continuously or intermittently as desired, and experiments have shown that a moisture retention rate of from 55 to 65 percent is desirable.

BRIEF DESCRIPTION OF THE DRAWINGS

Other objects, features and advantages of the invention, its organization, construction and operation will be best understood from the following description, taken in conjunction with the accompanying drawings, on which:

FIG. 1 is a perspective view of an automatic washing machine, shown with portions thereof cut away, in which the invention may be embodied;

FIG. 4 is a sectional view of a portion of the tub ring, taken generally along the line IV–IV of FIG. 1.

DESCRIPTION OF THE PREFERRED EMBODIMENT

Figure 2:
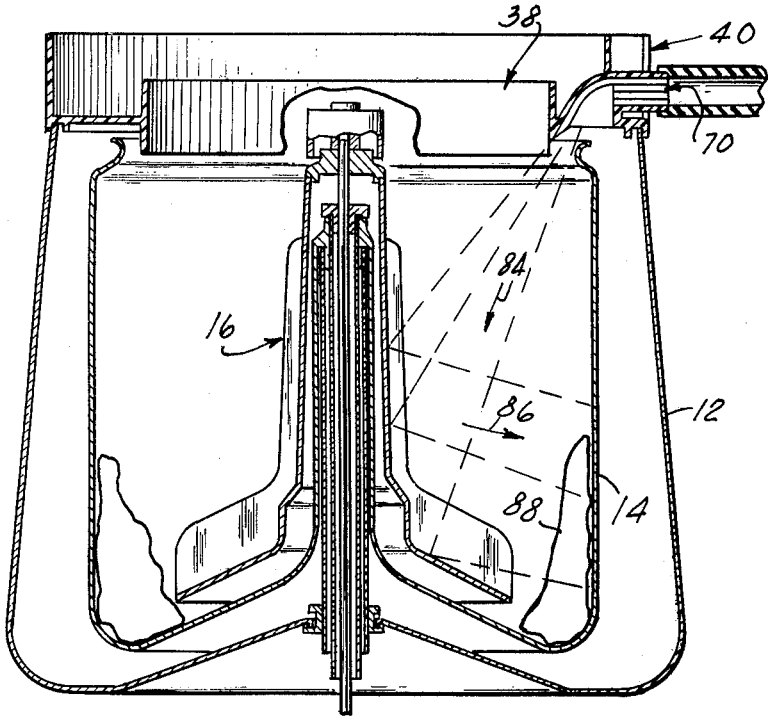
FIG. 2 is a sectional view of the tub, basket, agitator, tub ring, and water supply connection thereto of the automatic washing machine of FIG. 1 constructed in accordance with the principles of the present invention.

Referring to FIG. 1, an automatic washing machine is generally illustrated at 10 as comprising a tub 12 which has a perforate clothes container or spin basket 14 contained therein and an agitator 16 disposed within the spin basket and mounted for oscillatory movement with respect thereto and for spinning movement with the basket during centrifugal extraction of water from the clothes within the basket. The tub 12, the spin basket 14 and the agitator 16 and the drive mechanism therefor are contained in a cabinet 18.

The cabinet 18 is illustrated in FIG. 1 as having side walls 20 and 22, a back wall 24, and a front wall 26 detachably mounted on upright flanges 28 of a base 30, as, for example, by screws 32. The screws 32 may be self-tapping screws of a conventional form and may extend through the walls 20,22 and 24 and the flanges 30 to detachably secure the cabinet 18 to the base 30.

The cabinet 18 also includes a top 34 having a hinged lid 36 which may be opened to afford access to a clothes receiving opening 38 in a tub ring 40 extending about the tub and over a corresponding opening in the spin basket 14. The cabinet 18 also includes a timer dial 42 connected to a timer 44 which is mounted on the front wall 26 near the top of the cabinet beneath the top 34. Suitable wiring 46 connects the timer 44 to a drive motor 48 and to other electrical components of the machine. The timer dial 42 and the timer 44 may be mounted in any desired location and are shown in their present location for illustrative purposes only.

Supported above the cabinet base 30 on a plurality of vibration damping spring assemblies 50 is a base plate 52 forming a support for the tub 12, the spin basket 14, and the agitator 16, in a conventional manner. The base plate 52 may be supported on any suitable vibration damping spring assemblies which provide support for the base plate 52 from the cabinet base 30, and which absorb vibration during spinning movement of the spin basket 14. The base plate 52 also forms a support for the motor 48 and a drive control mechanism or transmission generally indicated by the reference numeral 56, which may also include a clutch and control mechanism, as well as a drive mechanism for oscillating the agitator 16 or spinning the spin basket 14 and releasing the agitator to spin freely with the basket.

A pump 58 is provided for removing wash or rinse water from the tub 12 at the termination of a washing or a rinsing operation and is suspended from the base plate 52 and connected to drain the tub 12 through a drain hose 60. It should be understood that the motor 48, the drive mechanism 56 and the pump 58 can be mounted in any convenient manner between the cabinet base 30 and the base plate 52 and need not necessarily depend from the base plate 52 as shown.

The cabinet 18 also forms a mounting for a suitable water inlet valve 62 of a conventional construction controlling the supply of water introduced to the tub 12 for a particular washing or rinsing operation. The water inlet valve provides selective fluid communication between an inlet hose 64 connected to a source of water under pressure and a conventional anti-siphoning device 68 which may be mounted on the tub ring 40.

Referring to FIGS. 2 and 4, the tub ring 40 is provided with a water passage, generally indicated by the arrow 70, which is formed by a cylindrical wall 72 and an arcuately-extending wall 74 so as to introduce a flow of water into the tub 12, and more particularly into the perforate basket 14. The flow passage 70 includes a plurality of ridges 76, some of which develop into arcuate elongated ridges 78 for directing the flow of water downwardly into the basket 14.

The tub ring 40 also includes means forming an annular groove 80 which receives the upper edge of the tub 12 and a sidewall 82 which, on the one hand, defines the opening 38 into the basket 14 and, on the other hand, with the groove 80 defines a space within which the basket 14 is free to rotate, and vibrate.

Referring specifically to FIG. 2, as the water is introduced into the perforate basket 14 during a spin cycle, it is directed to and assumes a spray path 84, then strikes and is deflected from the agitator 16, which is rotating with the basket, and thereafter assumes a spray path 86 so as to strike the fabrics 88 which are located against the inside wall of the basket 14 during spinning. Therefore, as water is being centrifuged from the fabric 88 and through the holes of the perforate basket 14, additional liquid, preferably water, is being added, in an atomized form, to the fabric 88 in order to maintain the moisture content thereof above a predetermined level, preferably in the range of from 55 to 65 percent.

As mentioned above, water may be added to the fabrics within the basket during the spin operation, either continuously or intermittently. Apparatus for controlling this addition of water to the fabric may be embodied as illustrated in FIG. 3.

Figure 3:
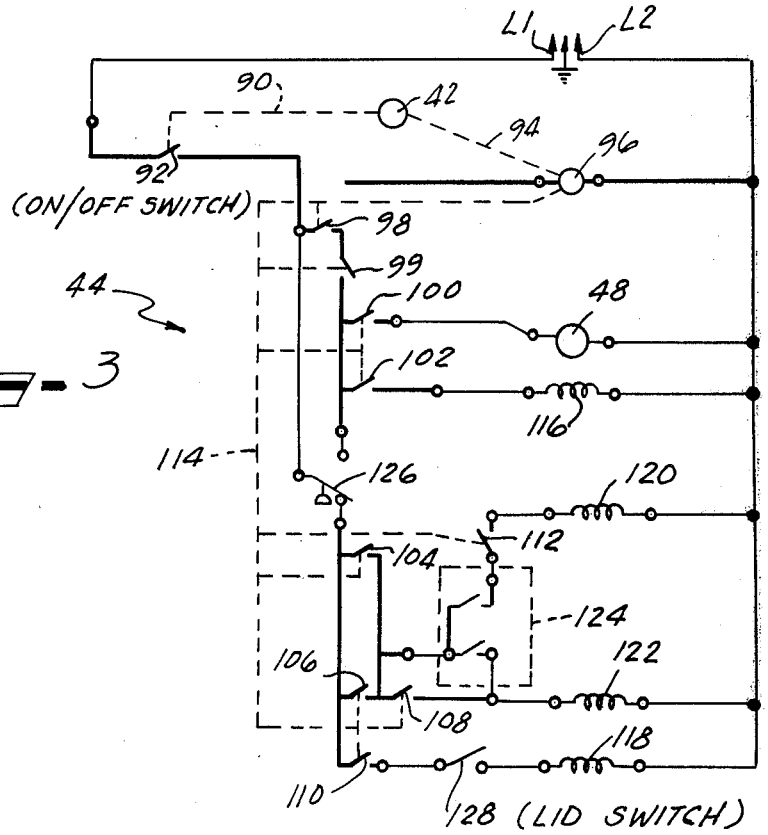
FIG. 3 is a simplified schematic wiring diagram of a control circuit for an automatic washer constructed in accordance with the present invention.

Referring now to FIG. 3, a control circuit for an automatic washer, which embodies the principles of the present invention, is illustrated, in a simplified form, as comprising a pair of electrical conductors L1 and L2 for connection to a conventional supply, such as 120 volts AC, 60 Hz.

A timer knob 42 is illustrated as being mechanically linked at 90 to an on/off switch 92, which is generally provided so that pushing of the timer knob 42 effects an off condition and pulling of the timer knob 42 effects an on condition.

The timer knob 42 actuates switch 92 which electrically controls a timer motor 96 which, as part of a programmer, drives a cam stack, illustrated by the broken line 114, to sequentially operate a plurality of contacts 98,99,100,102,104,106,108,110 and 112.

The control circuit 44 also comprises the drive motor 48, an agitate solenoid 116 and a spin solenoid 118 as portions of the control for transmission 56, a hot water solenoid 120, a cold water solenoid 122, and a water temperature control switch 124, as is fairly conventional in automatic washers.

Also, the control circuit is provided with a water level control switch 126 which prevents the application of power to the remainder of the circuit until such time as a selected water level is reached within the tub 12. The control circuit illustrated in FIG. 3 operates generally in a conventional manner. After the clothes load is placed in the basket 14 and the door 36 is closed, the lid switch 128 is closed and the timer knob 42 is rotated to the desired washing program and pulled to close the switch 92 so that through the water level switch 126, the timer contacts 104, the water temperature switch 124 and the timer contacts 112, water is added at a desired temperature to fill the tub 12 to a desired level, and the timer motor 96 and drive motor 48 are operated by way of the contacts 99 and 100, respectively, to initiate a washing program.

A washing program will generally involve the closure of the contacts 102 to cause the agitate solenoid 116 to be energized so that the transmission 56 causes oscillatory movement of the agitator 16 within the basket 14. Subsequently, the timer contacts 102 open and the timer contacts 110 close to energize the spin solenoid 118 and effect high speed rotation of the basket 14 and corresponding rotation of the agitator 16, as is generally well known in the art.

According to the invention, the cold water valve solenoid 122 is energized by way of timer contacts 108 and timer contacts 106 during the spin mode of operation. The contacts 106 may be continuously closed for a portion of the spin cycle, or may be intermittently or cyclically operated during this portion of the cycle to effect corresponding energization and deenergization of the cold water solenoid 122. When the cold water solenoid 122 is closed, water is supplied to the fabrics being centrifuged, as diagrammatically illustrated in FIG. 2.

As mentioned above, water is sprayed onto the fabrics so as to maintain a predetermined moisture content level in the fabrics during the centrifuging operation. This moisture content level has been determined to be desirable in the range of from 55 to 65 percent.

Although we have described our invention by reference to a particular illustrative embodiment thereof, many changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

The embodiments of the invention in which an exclusive property or privilege is claimed are defined as follows:

1. In a method of washing permanent press fabric wherein the permanent press fabric is agitated in a washing liquid, rinsed in a rinsing liquid after removal of the washing liquid and then centrifuged to remove the rinsing liquid, the improvement comprising the step of: adding moisture to the permanent press fabric during centrifuging to maintain the moisture level above a desired level to minimize setting of wrinkles in the permanent press fabric.

2. The improvement set forth in claim 1, wherein the step of adding moisture is further defined as adding moisture to maintain a moisture level in the range of 55 to 65 percent.

3. A method of washing permanent press items comprising the steps of placing the items in a receptacle, adding wash liquid to the receptacle, agitating the items and the wash liquid within the receptacle, removing the wash liquid from the receptacle, adding rinse liquid to the receptacle, and removing the rinse liquid from the receptacle and centrifuging the rinse liquid from the items while adding moisture to the items to maintain the moisture content of said items above a desired level, whereby the setting of wrinkles in the permanent press items is minimized.

4. A method of laundering permanent press items in a laundry apparatus of the type which has a rotatable receptacle forming a laundering zone for receiving the permanent press items and in which the items are laundered in separate washing, rinsing and liquid extraction periods of an operational cycle, comprising the steps of:

adding wash liquid to the receptacle;

agitating the items and the wash liquid in the receptacle during the washing period of the operational cycle;

removing the wash liquid from the receptacle;

adding rinse liquid to the receptacle to remove detergent and washing additives from the items during the rinsing period of the operational cycle;

removing the rinse liquid from the receptacle at the end of the rinsing period of the operational cycle;

rotating the receptacle at a high speed during the rinsing period and during the subsequent liquid extraction period of the operational cycle; and adding a selected quantum of moisture to the permanent press items during the liquid extraction period to maintain the moisture level of the items above a predetermined level to prevent the setting in of wrinkles in the items.

5. The method of laundering permanent press items as set forth in claim 4, wherein the step of adding a selected quantum of liquid is further defined as:

feeding a stream of liquid into the receptacle;

atomizing the stream of liquid; and deflecting the atomized liquid onto the items.

6. The method of laundering permanent press items as set forth in claim 4, wherein the step of adding a quantum of liquid is further defined as:

selecting a quantum of liquid to provide a moisture content in the range of 55 to 65 percent.

* * * * *